United States Patent [19]

Brodnax

[11] Patent Number: 4,660,237

[45] Date of Patent: Apr. 28, 1987

[54] PORTABLE RECLINER

[75] Inventor: William E. Brodnax, Alexandria, La.

[73] Assignee: Robert P. Descant, Alexandria, La. ; a part interest

[21] Appl. No.: 691,295

[22] Filed: Jan. 14, 1985

[51] Int. Cl.[4] ..... A47C 20/00; A47C 7/54

[52] U.S. Cl. ..... 5/74 R; 5/75; 5/77; 5/433; 297/377; 297/416

[58] Field of Search ..... 5/74 R, 75, 77, 43 R, 5/433, 434, 437; 297/377, 183, 415, 416, 366–368

[56] References Cited

U.S. PATENT DOCUMENTS

| | | | |
|---|---|---|---|
| 507,921 | 10/1893 | O'Brien | 297/368 |
| 664,322 | 12/1900 | Jacobs | 297/368 |
| 2,304,700 | 12/1942 | Manville | 297/183 |
| 2,429,795 | 10/1947 | Blanchard et al. | 5/432 |
| 2,663,029 | 12/1953 | Whitley et al. | 5/433 |
| 2,777,138 | 1/1957 | Gallagher | 5/433 |
| 2,983,310 | 5/1961 | Warlick et al. | 5/434 |
| 3,018,132 | 1/1962 | Baker et al. | 5/433 |
| 3,269,621 | 8/1966 | Dishart | 5/434 |
| 3,329,979 | 7/1967 | Drapin | 5/433 |
| 3,343,185 | 9/1967 | Nemser | 5/432 |
| 4,118,069 | 10/1978 | Hunter | 297/416 |
| 4,165,125 | 8/1979 | Owen | 5/434 |
| 4,410,214 | 10/1983 | Geschwender | 5/432 |

*Primary Examiner*—Alexander Grosz
*Assistant Examiner*—Michael F. Trettel

[57] ABSTRACT

A portable recliner which includes a base frame designed to rest on a supporting surface, a back frame hinged at the lower end to one edge of the base frame, with a cushion provided on the back frame, and an adjustable brace having an extending member projecting downwardly from points of pivot in the back frame for engagement with notches provided in the base frame and handles fitted on the ends of the adjustable brace projecting through the back frame, for effecting adjustment of the extending member in the notches to vary the angle of repose of the back frame with respect to the base frame. In a preferred embodiment a head rest is removably secured to the cushion located on the back frame and the cushion extends beyond the back frame against the supporting surface. In another preferred embodiment a pair of arm rests are pivotally secured to the back frame in engagement with the handles for adjusting the extending member in the notches responsive to pressure applied on the arm rests.

10 Claims, 5 Drawing Figures

PORTABLE RECLINER

BACKGROUND OF THE INVENTION

This invention is a novel and improved article of furniture, a recliner used for body supporting purposes, either as an adjustable back-rest or an adjustable leg rest. Designed as an inexpensive substitute for a hospital bed for the handicapped and elderly, it can also be used as a leisure time floor rest. It is described and illustrated with two options. Option #1 is a detachable head rest pillow. Option #2 is a pair of detachable cushioned arm rests.

An object of this invention is to provide a recliner which is generally rectangular in configuration, consisting of a cushion supported by an adjustable back frame which is hinged or pivotally attached to a horizontal base frame. An adjustable supporting brace is pivotally attached to the back frame and selectively engages a plurality of pairs of semi-circular notches cut into the upper edges of two aluminum angles which are attached to the base frame, allowing an adjustment of incline or angle of repose in the recliner. The reclining angle is adjusted by a convenient and novel handle-brace combination, easily accessed and adjusted by either hand. The recliner is easily carried in a vertical position by grasping the back and the self-forming handle. It is lightweight and ideal for the handicapped or elderly. The above mentioned features are illustrated in the following drawings.

BRIEF DESCRIPTION OF THE DRAWINGS

FIG. 1 shows the optional arm rests in place and the optional head rest pillow as it attaches to the recliner;

DESCRIPTION OF THE PREFERRED EMBODIMENTS

Figure 1:
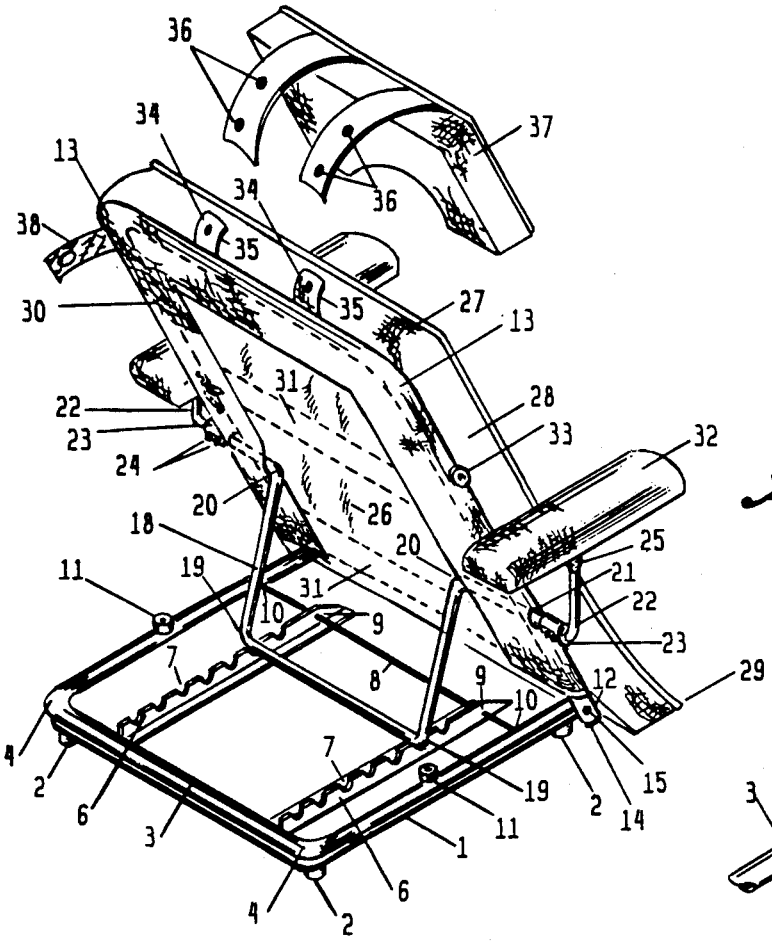
FIG. 1 is a back isometric view illustrating a preferred handle brace assembly as it locks into the apertures of the aluminum angles of the base frame.

In particular, the base assembly shown in FIG. 1 includes a water resistant, tempered, Masonite board 1 resting on four rubber bumpers 2 attached with rivets (not illustrated) at each of the four corners of the Masonite board 1. The base frame 3 of lightweight aluminum tubing is bent at right angles 4 to form a U-shape and is attached to the Masonite board 1 with more rivets (not illustrated). End caps 5 (see FIG. 2) are placed in the ends of the tubing to protect the edges. Two lengths of aluminum angle 6, with sets of corresponding semi-circular notches 7 cut in the upper edges, are placed with the inside angles facing one another and parallel to one another and parallel to the sides of the base frame 3. The bottom side of the aluminum angles 6 are attached to the Masonite board 1 with additional rivets (not illustrated).

A stress distribution rod 8 of steel is inserted into and through openings 9 provided in the upper edges of the aluminum angle supports 6 and is secured in openings 10 in the inner edge of the base frame 3. The stress distribution rod 8 acts to stabilize and strengthen the base frame 3. Additional rubber bumpers 11 are mounted by means of rivets or screws on top of the edge of the base frame 3 to maintain space between the base frame 3 and the back frame 12 when the recliner is collapsed while being carried. Alternatively, the recliner can be used in collapsed configuration when minimum elevation is needed.

Figure 2:
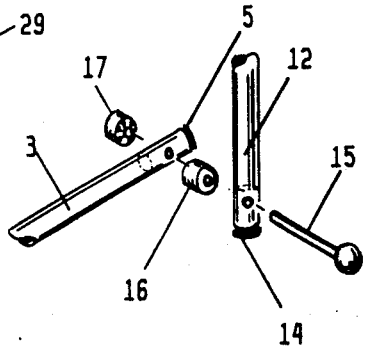
FIG. 2 is a detail of the back frame and base frame as they are hinged or pivotally joined together.

As shown in FIGS. 1 and 2, the back frame 12 is constructed of lightweight aluminum tubing bent at right angles 13 to form a U-shape. End caps 14 are placed in the ends (see FIG. 2) to cover the edges and protect surfaces beneath. The back frame 12 is pivotally attached to the base frame 3 in a hinged relationship by means of a steel pin 15 (see FIG. 2) passing through the back frame 12, through a hard plastic spacer 16, through the base frame 3, and secured by a self-locking nut 17.

Also shown in FIG. 1, attached to the back frame 12, is the adjustable brace 18. The adjustable brace 18 is a sturdy steel rod bent at right angles 19 to form a U-shape. The ends of the brace 18 are bent at opposite right angles 20 in the same plane. Both the ends of the brace 18 and the ends of the handles 22 are provided with corresponding milled flats (not shown) which are joined by means of a steel coupling 23 and two allen set screws 24. Plastic end caps 25 cover the ends of the handles 22. The handles 22 and the brace 18 act as one and become the controlling lever, providing a means of adjustment of the angle of incline or repose of the recliner by selectively locking into any of seven sets of parallel, semi-circular notches 7 provided in the upper edges of the two aluminum angle supports 6. This arrangement allows an easy release and angle adjustment of the back frame 12 using either of the handles 22, to any of seven angles of incline, the most upright angle being 60 to 55 degrees, and adjusting to angles of 45, 40, 35 degrees, respectively, and finally, to the lowest angle of incline, 30 degrees.

Figure 4:
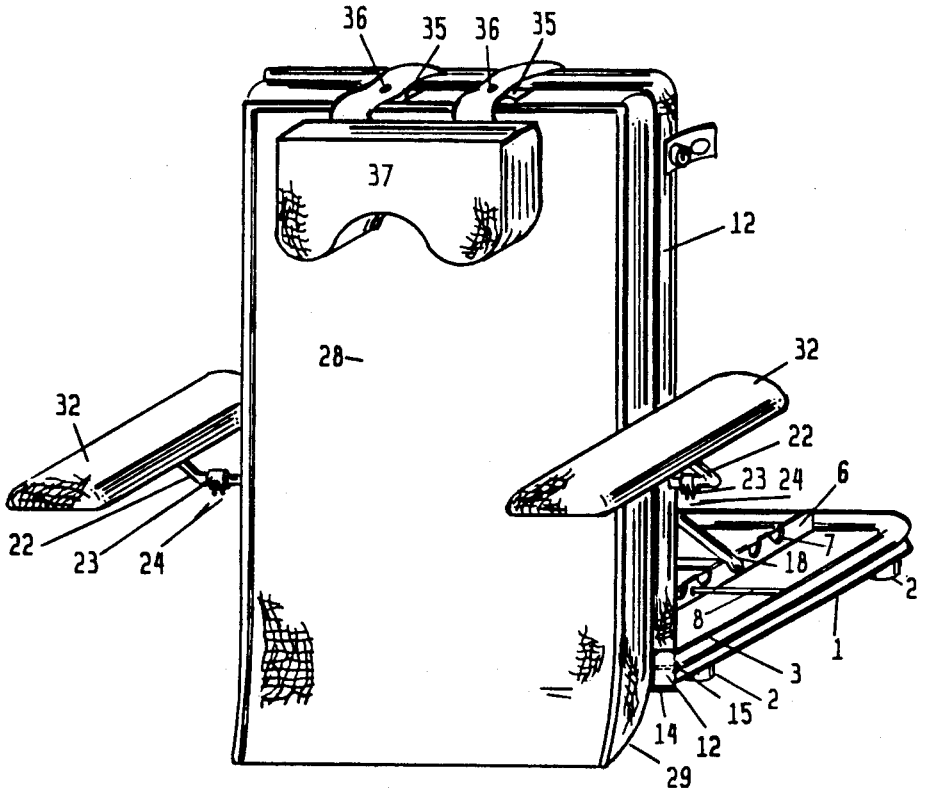
FIG. 4 is a front isometric view of the recliner showing the optional head rest and arm rests in place.
Figure 5:
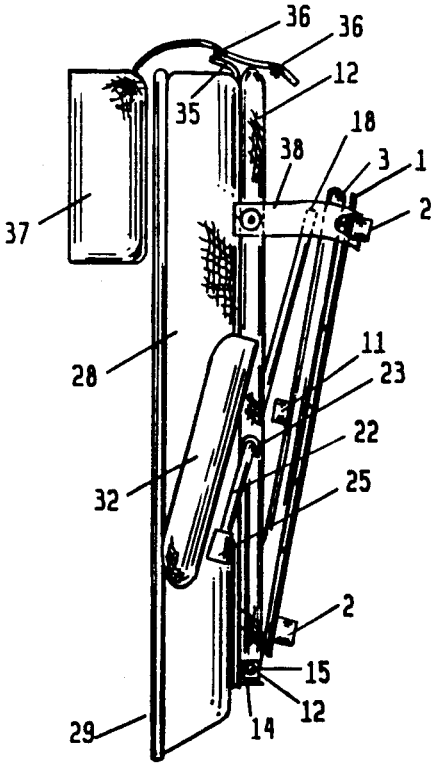
FIG. 5 is a side view of the recliner in a collapsed or folded configuration. This view shows the attachment of the optional head rest pillow and the securing of the recliner in carrying configuration by use of a leather loop.

As further illustrated in FIGS. 1, 4 and 5, the frame upholstery 26 is a fabric of strong, open weave polyester fibers securely sewn around and riveted to the back frame 12. It provides a permanent, strong, firm, yet resilient support for the recliner cushion 28. The outer upholstery pocket 27 encloses the recliner cushion 28. The recliner cushion 28 is characterized by a thick polyurethane foam cushion sized to conform to the size and shape of the back frame 12 and extending below the lower edge of the back frame 12 to define an extension 29. (see FIGS. 4 and 5) The extension 29 provides added support for the lower back when reclining. The recliner cushion 28 is wrapped with polyester batting (not shown) to provide stability and softness for the recliner cushion 28 once it is inserted within the outer upholstery pocket 27 through a zippered opening (not shown) at the bottom of the outer upholstery pocket 27.

Referring again to FIG. 1 of the drawings the outer upholstery pocket 27 is attached by machine stitching to the upholstery base 30 of the same upholstery fabric. It slips over the back frame 12 and is held firmly in place by two strips of elastic webbing 31. Metal grommets (not shown) are attached to the upholstery base 30 at the openings where the handle 22 is attached to the adjustable brace 18 and extends through the back frame 12. The arm rests 32 and the handle 22 are easily removed by detaching the handle 22 with a household screwdriver and allen wrench, in order to remove the upholstery for cleaning. The arm rest is easily removed by exerting pressure outwardly. The rubber bumpers 33 are provided on the back frame 13 for purposes hereinafter described and are secured by means of screws.

As shown in FIGS. 1, 4, and 5 at the top of the cushion 28, sewn in the seam of the upholstery pocket 27 and upholstery base 30, are two straps 34, provided with female snaps 35 that attach to two sets of male snaps 36 located on the straps of the optional, detachable head rest pillow 37 to allow for the adjustment in height of the head rest pillow 37. The head rest pillow 37 is characterized by a foam cushion covered in the same upholstery fabric as the recliner. It has a zippered opening (not shown) for the insertion of the foam cushion and removal of the upholstered cushion cover for cleaning.

Figure 3:
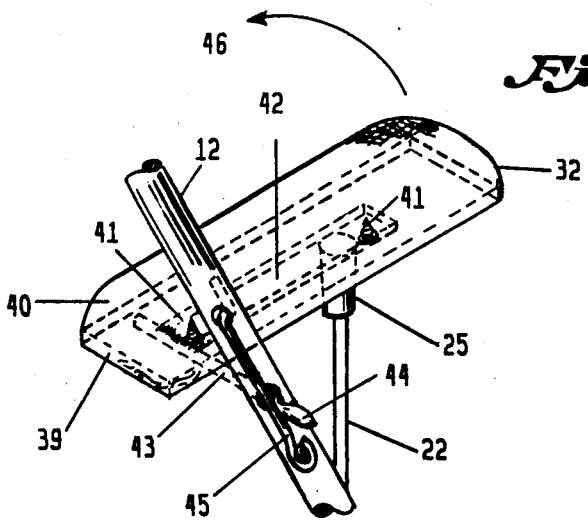
FIG. 3 illustrates the assembly of the optional arm rests, and their retention into the back frame by means of the tension spring. It also shows the tension retainer spring to be a strong wire spring retained in the body of the back frame tubing at the top of the spring and attached with a rivet at the bottom of the spring to the back frame. This view also illustrates how the end caps of the handles rest on the steel plates of the arm rests.

As shown in FIGS. 1, 3, 4, and 5, and in detail in FIG. 3, the optional detachable upholstered arm rests 32 provide comfort when the recliner is used as a back rest. The arm rests 32 are each characterized by a plywood base 39 (see FIG. 3) overlaid with a foam cushion 40, conforming in size and shape to the plywood form 39 and covered in the same upholstery fabric as the back rest 13 of the recliner. The plywood base 39 is attached with screws 41 to a steel base plate 42 that has been welded to a sturdy steel rod 43, which has been machined at the ends 44 and is designed to fit and be held in place by the sturdy retainer tension spring 45 (see FIG. 3). The arm rests 32 are held firmly by the retainer tension spring 45, yet retain their freedom of rotational movement, as illustrated by the arrow 46. As shown in FIGS. 1 and 3, the arm rests 32 rest on the plastic end cover 25 of the sturdy steel handle 22, the handle being designed to carry the weight placed on the arm rest and distribute it through the brace 18 and the stress distribution rod 8, to the base frame 3. The angle of incline or repose of the arm rests 32 is automatically changed as the angle of the handles 22 and brace 18 combination is changed, providing a comfortable arm rest at any angle of repose to which the recliner is adjusted.

FIG. 4 shows the recliner in a front isometric view with the optional arm rests 32 and optional head rest pillow 37 in place. In a preferred embodiment, and as heretofore described, the back rest cushion 28 extends at 29 below the bottom of the back frame 12 for comfortable back support.

FIG. 5 shows the recliner in a collapsed state and indicates the self-forming handle of the brace 18. This figure also shows the leather loop 38 in place securing the recliner for carrying. The recliner is designed to be carried in a vertical manner by the self-forming handle of the brace 18 by grasping the brace 18 and base edge 1 of the recliner. It is ideal for the handicapped and elderly as it is lightweight and purposefully balanced for easy carrying. The leather loop 38, shown in FIGS. 1 and 5, is provided at the top left side of the recliner and is held to the back frame 12 with the rubber bumper 33 (shown in FIG. 5). This loop 38 fastens over the corresponding rubber bumper 2 on the bottom of the masonite base 1 and secures the recliner while being carried.

Having described my invention with regard to the drawings defined above, what is claimed is:

1. A portable recliner comprising a base frame for resting on a supporting surface; retainer means secured to said base frame; a back frame pivotally attached to one edge of said base frame; a generally U-shaped adjustable brace having a bottom segment engaging said retainer means and upward standing segments extending through said back frame in spaced, pivotal relationship for varying the angle of repose of said back frame with respect to said base frame; arm rest means pivotally carried by said back frame; and a pair of handle segments projecting from said upward standing segments, and engaging said arm rest means, whereby adjustment of said handle segments exerts pressure on said adjustable brace and adjusts said adjustable brace in said retainer means to change said angle of repose.

2. The portable recliner of claim 1 wherein said arm rest means is a pair of arm rests pivotally carried by said back frame in spaced relationship, and said arm rests supported by said handle segments, respectively, and said retainer means is a pair of angle bars attached to said base frame in spaced relationship, each of said angle bars having a plurality of slots provided therein.

3. The portable recliner of claim 2 further comprising tension means provided in said back frame for applying tension to said arm rests when said arm rests are pivoted with respect to said back frame.

4. The portable recliner of claim 3 further comprising:

(a) cushion means extending beyond the bottom edge of said back frame adjacent the supporting surface; and (b) a head rest carried by said back frame and resting against said cushion means.

5. The portable recliner of claim 3 further comprising a pair of rods fixedly secured to said arm rests, respectively, said rods each extending through said back frame in contact with said tension means, whereby said rods are biased in said back frame.

6. The portable recliner of claim 5 further comprising:

(a) a cushion carried by said back frame, said cushion extending beyond the bottom edge of said back frame adjacent the supporting surface; and (b) a head rest carried by said back frame and resting against said cushion.

7. The portable recliner of claim 1 wherein said retainer means is a pair of angle bars attached to said base frame in spaced relationship, each of said angle bars having a plurality of slots provided therein to receive said adjustable brace means.

8. The portable recliner of claim 1 further comprising a head rest carried by said back frame.

9. The portable recliner of claim 1 further comprising cushion means carried by said back frame, said cushion means extending beyond the bottom edge of said back frame adjacent the supporting surface.

10. The portable recliner of claim 1 further comprising:

(a) cushion means carried by said back frame, said cushion means extending beyond the bottom edge of said back frame adjacent the supporting surface; and (b) a head rest carried by said back frame and resting against said cushion means.

* * * * *